United States Patent [19]

Schexnayder

[11] 4,094,228

[45] June 13, 1978

[54] FLUID SYSTEM HAVING LOAD PRESSURE EQUALIZING VALVE ASSEMBLIES

[75] Inventor: Lawrence F. Schexnayder, Joliet, Ill.

[73] Assignee: Caterpillar Tractor Co., Peoria, Ill.

[21] Appl. No.: 804,195

[22] Filed: Jun. 6, 1977

[51] Int. Cl.[2] ..... F15B 11/22

[52] U.S. Cl. ..... 91/411 B; 60/484

[58] Field of Search ..... 91/411 B, 411 R, 170 R, 91/170 MP; 60/484, 455

[56] References Cited

U.S. PATENT DOCUMENTS

| | | | |
|---|---|---|---|
| 3,198,088 | 8/1965 | Johnson et al. | 91/420 |
| 3,411,521 | 11/1968 | Johnson | 137/99 |
| 3,807,175 | 4/1974 | Kubik | 60/444 |
| 3,906,991 | 9/1975 | Haussler | 137/630.13 |

*Primary Examiner*—Edgar W. Geoghegan
*Attorney, Agent, or Firm*—John W. Grant

[57] ABSTRACT

A fluid system has first and second hydraulic jacks each having a load supporting end connected to a source of fluid through a control valve. First and second pilot operated valve assemblies are positioned between the control valve and the load supporting ends with each valve assembly having a first check valve positioned in a chamber and being movable between a first position at which communication between the associated load supporting end and the control valve is blocked and a second position at which the associated load supporting end is in fluid communication with the control valve. A second check valve is associated with the first check valve and is movable between a first position at which communication between the chamber and the control valve is blocked and a second position at which the chamber is in fluid communication with the control valve. A first piston is provided for urging the second check valve toward the first position and a second piston is provided for initially moving the second check valve to the second position and for subsequently moving the first check valve to the second position. A signal device senses the load pressure in the load supporting ends and delivers first and second control signals to the first piston of the respective first and second valve assemblies.

11 Claims, 1 Drawing Figure

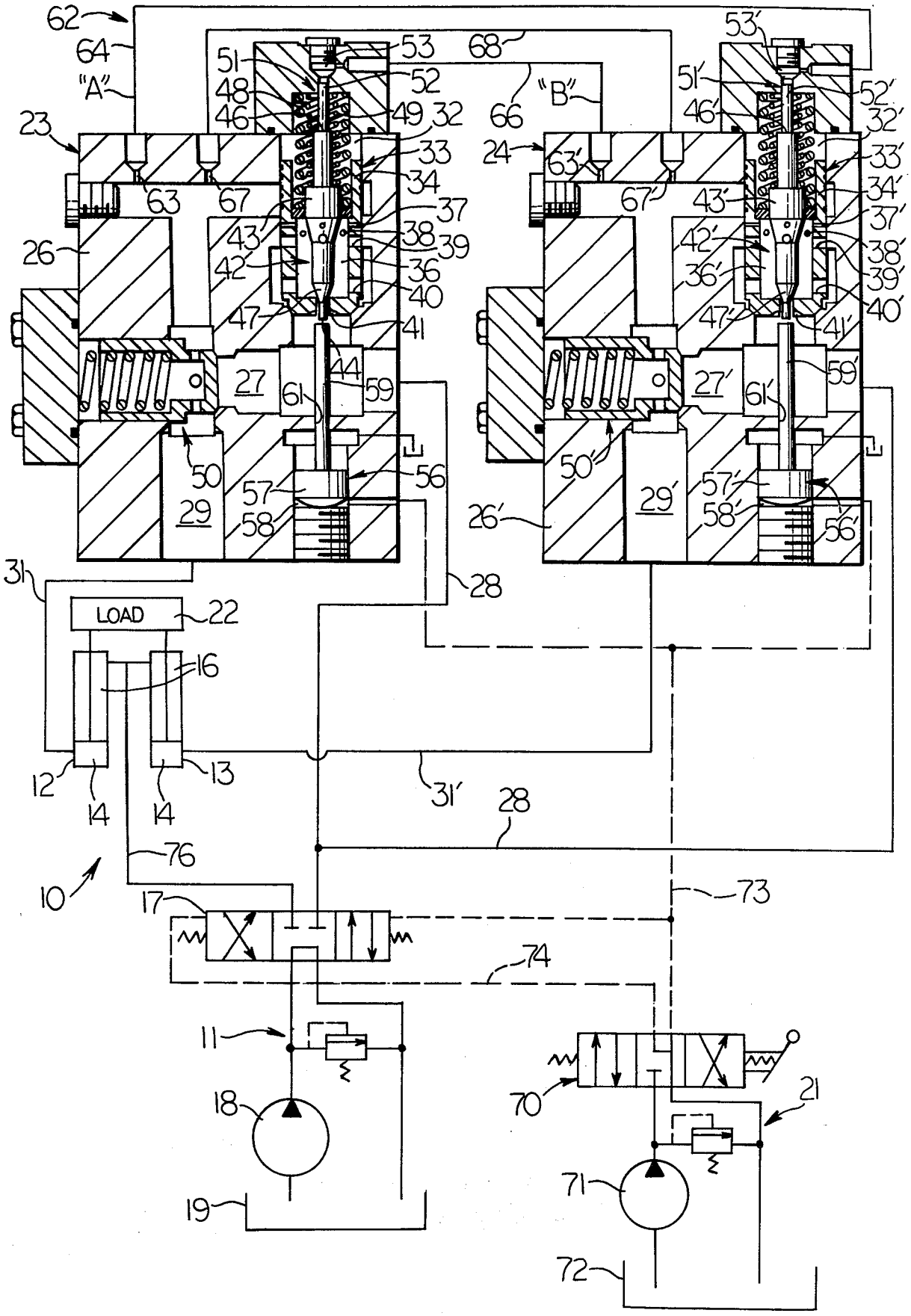
LOAD
"A"
"B"

FLUID SYSTEM HAVING LOAD PRESSURE EQUALIZING VALVE ASSEMBLIES

BACKGROUND OF THE INVENTION

Hydraulic systems frequently employ a hydraulic motor to raise and lower relatively heavy loads and at times to support such loads in an elevated position. When the motor is required to support the load in such elevated position, it is normally desirable to isolate the relatively high load generated pressure in the load supporting end of the motor from the remainder of the system. This is to prevent the downward drifting of the load due to leakage past the valve spools of the conventional control valves normally used in such systems. The load pressure is also normally isolated to prevent the sudden dropping of the load in the event of line failure or the like.

In earthmoving vehicles, such as hydraulic excavators and the like, where two or more hydraulic motors are connected to a boom to operate in unison for raising and lowering the load, a pair of load check valve assemblies are sometimes mounted on the hydraulic motors. It is desirable that the fluid pressure in the motors be substantially equal to prevent uneven operation and distortion of the excavator boom. However, due to manufacturing tolerances, it has heretofore been a problem of assuring that the valve assemblies open simultaneously and equally so that the fluid pressure in the motors remain equal during lowering. For example, when the boom is being lowered slowly, one valve assembly may open slightly before the other valve assembly permitting fluid pressure in the fluid motor controlled by that valve assembly to decay rapidly with a corresponding increase in the fluid pressure in the other hydraulic motor since it then carries more of the load.

The present invention is directed to overcoming one or more of the problems as set forth above.

SUMMARY OF THE INVENTION

According to the present invention, a fluid system has a source of fluid, a control valve, first and second hydraulic jacks each having a load supporting end connected to the source of fluid through the control valve and first and second pilot operated valve assemblies positioned between the control valve and the load supporting ends. Each valve assembly has a housing having a chamber formed therein, a first check valve positioned in said chamber and being movable between a first position at which communication between the associated load supporting end and the control valve is blocked and a second position at which the associated load supporting end is in fluid communication with the control valve. A second check valve is associated with the first check valve and is movable between a first position at which communication between the chamber and the control valve is blocked and a second position at which the fluid is in fluid communication with the control valve. A first piston means urges the second check valve toward the first position and a second piston means initially moves the second check valve to the second position and subsequently moves the first check valve to the second position. A signal means senses the load pressure in the load supporting end and delivers first and second control signals to the first piston means of the respective first and second valve assemblies.

BRIEF DESCRIPTION OF THE DRAWING

The sole FIGURE is a diagrammatic view of the fluid system of this invention.

DETAILED DESCRIPTION

Referring to the drawing, a fluid system 10 has a source of fluid 11, first and second hydraulic lift jacks 12 and 13 each having a head end 14 and a rod end 16 connected to a directional control valve 17. The source of fluid includes a pump 18 and a tank 19 connected to the control valve in the usual manner. The control valve is of the type which is pilot operated and is shifted by pressurized fluid from an independent source of fluid 21. The jacks are illustrated as supporting a load 22 so that the head ends are to be considered as the load supporting ends. Such a fluid system may be typically employed on a hydraulic excavator in which the load would be the boom or a loader in which the load would be the lift arms.

First and second pilot operated valve assemblies 23, 24 are positioned between the control valve 17 and the head ends 14 of the hydraulic jacks 12, 13. The valve assemblies are identical in construction and only valve assembly 23 will be described in detail with primed reference numerals applied to counterpart elements of the valve assembly 24.

Although the first and second valve assemblies 23, 24 are illustrated as being somewhat spaced from the jacks 12, 13 they are preferably mounted directly on their respective jacks or integral therewith to alleviate the possibility of a line failure between the jacks and the valve assemblies.

The valve assembly 23 includes a housing 26 having a first port 27 connected to the control valve 17 through a first conduit 28, a second port 29 connected to the head end 14 of the jack 12 through a second conduit 31 and a chamber 32 positioned between and in communication with the first and second ports. A first check valve 33 has a cylindrical body 34 slidably positioned within the chamber and is movable between a first position at which communication between the first and second ports 27, 29 and hence the head end of jack 12 and the control valve is blocked and a second position at which the control valve is in communication with the head end of jack 12 through the first and second ports.

The first check valve 33 is of a construction sufficient for selectively modulating the fluid flow from the head end 14 of jack 12 to the control valve 17. The body has a cavity 36 formed therein opening into the chamber and first, second, third and fourth sets of passages 37, 38, 39, 40 extending through the wall. Each set of passages are axially offset from each other with the second passages being larger than the first passages and smaller than the third passages. At the first position of the first check valve, none of the passages communicates with either the first or second ports 27, 29. At the second position of the first check valve, the second port is in fluid communication with the cavity 36 through at least the first passages 37 while the cavity is in fluid communication with the first port through the fourth passages 40. A fifth passage 41 extends through the end of the cylindrical body and communicates the cavity with the first port.

A second check valve 42 includes an elongated stem 43 positioned within the cavity 36 of the cylindrical body 34. The stem is movable between a first position at which communication between the chamber 32 and the control valve 17 is blocked and a second position at which the chamber is in fluid communication with the control valve by way of the cavity 36, fifth passage 41, first port 27 and first conduit 28. The elongated stem has first and second ends 44, 46 and a conical seat 47 formed thereon adjacent the first end. At the first position of the second check valve, the first end extends through the fifth passage 41 and the conical seat is in sealing engagement with the fifth passage to block communication between cavity 36 and the first port 27.

A pair of springs 48, 49 are positioned within the chamber 32 and resiliently urge the cylindrical body 34 and the elongated stem 43 to the first positions.

A third check valve 50 is positioned in parallel with the first check valve 33 and is movable between a first position at which fluid in the second port 29 is blocked from the first port 27 and a second position at which fluid can freely flow between the first and second ports.

A first piston means 51 is provided for urging the stem 43 of second check valve 42 towards the first position. The first piston means includes a first piston 52 having a first end positioned within an actuating chamber 53 and a second end in engagement with the second end 46 of the stem 43 of the second check valve.

A second piston means 56 is provided for initially moving the stem 43 of the second check valve 42 to the second position and for subsequently moving the cylindrical body 34 of the first check valve 33 to the second position. The second piston means includes a second piston 57 slidably disposed within a second actuating chamber 58. A reduced diameter portion 59 of the second piston extends through a bore 61 and is positioned for engagement with the first end 44 of the stem 43 and the end of the cylindrical body 34.

A signal means 62 is connected with the head ends 14 of the jacks 12, 13 for sensing the load pressure in the head ends and delivering first and second control signals "A" and "B" in response thereto. The first signal A is passed through a first orifice 63 connected to the second port 29 of first valve assembly 23 and a first line 64 connecting the first orifice to the first actuating chamber 53' of valve assembly 24. The second signal "B" passes through first orifice 63' and a second line 66 to the first actuating chamber 53 of valve assembly 23. Second orifices 67, 67' connected to the second ports 29, 29' of the respective valve assembly are interconnected through a third line 68 to equalize the load pressures in the head end of the jacks at the first position of the first, second and third check valves.

The independent source of fluid 21 is associated with the second piston means 56, 56' for moving the first and second check valves 33, 33' and 42, 42' to the second positions. The independent source of fluid is part of a pilot control circuit and includes a manually actuated selector valve 70 connected to a pump 71 and a tank 72 in the usual manner. A first pilot line 73 connects the selector valve to the right end of the control valve 17 and the second actuating chambers 58, 58' of the valve assemblies 23, 24. A second pilot line 74 connects the selector valve with the left end of the control valve 17.

In operation, the operator shifts the selector valve 70 to the right to raise the load 22. In so doing, pilot fluid is directed through the second pilot line 74 causing the control valve 17 to be shifted to the right. At this position pressurized fluid from the pump 18 passes through the first conduit 28 into the first ports 27, 27' of the valve assemblies 23, 24 where it moves the third check valves 50, 50' to the second position. Pressurized fluid then passes through the second ports 29, 29' second conduits 31, 31' to the head ends 14 of the jacks 12, 13. The fluid exhausted from the rod ends 16 passes through a third conduit 76 and the control valve 17 to the tank 19. Should the load be maintained in the raised position for an extended time, small amounts of fluid may normally leak through the various valves in the system. When this occurs, the second orifices 67, 67' and the third line 68 permit the transfer of fluid from the head end 14 of one of the hydraulic jacks 12 or 13 to the head end of the other hydraulic jack to compensate for slight differences in the leakage rate and to equalize the pressure in the head ends of the hydraulic jacks.

To lower the load, the selector valve 70 is shifted to the left delivering pressurized fluid through the first pilot line 73 to the right end of the control valve 17 and to the second actuating chamber 58, 58' of the valve assemblies 23, 24. The fluid at the right end of the control valve 17 moves it to the left connecting the third conduit 76 with the pump 18 and the first conduit 28 to the tank 19. The pressurized fluid in the second actuating chambers causes the second pistons 57, 57' to move toward the first and second check valves 33, 33' and 42, 42'. The ends of the reduced diameter portions 59, 59' engage the first end 44, 44' of the stems 43, 43'. Since, as previously described, the fluid pressure in the head ends 14 of the jacks 12, 13 and thus the second ports 29, 29' is substantially equal, the first and second control signals "A" and "B" are substantially equal and the force exerted by the first piston means 51, 51' against the stems 43, 43' is also substantially equal. Thus, the second pistons 56, 56' move the stems simultaneously to their second position. The end of the reduced diameter portions subsequently engages the ends of the cylindrical bodies 34, 34' of the first check valves 33, 33' moving them to their second position at which fluid communication is established between the first and second ports 27, 27' and 29, 29'. This permits fluid exhausted from the head end of the jacks to pass through the respective valve assembly to the control valve and hence the tank.

By modulating the selector valve 70, the pressure in the second actuating chambers 58, 58' can be modulated to control the position of the cylindrical bodies 34, 34' and hence the fluid flow between the first and second ports 27, 27' and 29, 29'. For example, at a relatively lower pressure in the second actuating chambers, only the first passages 37, 37' will be in communication with the second ports thereby permitting only a small flow of fluid from the second ports to the first ports. Conversely, at a high pressure in the second actuating chamber, the first, second and third passages 37, 37' and 38, 38' and 39, 39' will be connected with the second ports thereby permitting maximum fluid flow from the second ports to the first ports. At intermediate pressures the fluid flow from the second ports to the first ports will be commensurate with the fluid pressure in the second chambers.

As stated above, the first check valves 33, 33' are normally opened simultaneously. However, due to manufacturing tolerances, one of the cylindrical bodies 34, 34' may move at a faster rate and reach its second position prior to the other cylindrical body reaching its second position. For example, assume that the cylindrical body 34 reaches its second position first. When this happens, the load pressure in the head end 14 of the jack 12 and thus the second port 29 starts to decay with a corresponding build-up of load pressure in the head end 14 of the jack 13 and the second port 29'. Thus, the first control signal "A" becomes greater than the second control signal "B" and exerts a greater force on the first piston 52 than is exerted on the first piston 52'. This greater force by the first piston 52 moves the first and second check valves 33 and 42 toward their first position. In the mean time, the cylindrical body 34' continues to move toward and subsequently reaches its second position to communicate the second port 29' with the first port 27'. In so doing, the load pressure in the head end 14 of jack 13 starts to decrease and the differences between the first and second control signals decreases, permitting the cylindrical body 34 to again move to its second position simultaneously with the cylindrical body 34' moving to its second position.

Other aspects, objects and advantages of this invention can be obtained from a study of the drawing, the disclosure and the appended claims.

The embodiments of the invention in which an exclusive property or privilege is claimed are defined as follows:

1. In a fluid system having a source of fluid, a control valve, first and second hydraulic jacks each having a load supporting end connected to the source of fluid through the control valve, the improvement comprising:

first and second pilot operated valve assemblies positioned between the control valve and the load supporting ends, each vavle assembly having a housing having a chamber formed therein, a first check valve positioned in said chamber and being movable between a first position at which communication between the associated load supporting end and the control valve is blocked and a second position at which the associated load supporting end is in fluid communication with the control valve, a second check valve associated with the first check valve and being movable between a first position at which communication between the chamber and the control valve is blocked and a second position at which the chamber is in fluid communication with the control valve, first piston means for urging the second check valve toward the first position, and second piston means for initially moving the second check valve to the second position and for subsequently moving the first check valve to the second position; and signal means for sensing the load pressure in the load supporting ends and for delivering first and second control signals to the first piston means of the respective first and second valve assemblies.

2. Apparatus, as set forth in claim 1, wherein the first check valve is of a construction sufficient for selectively modulating the fluid flow from the associated load supporting end to the control valve.

3. Apparatus, as set forth in claim 2, wherein each valve assembly includes a third check valve connected in parallel with the first check valve and being movable between a first position at which fluid flow between the associated load supporting end and the control valve is blocked and a second position at which fluid flow is permitted between the control valve and the associated load supporting end.

4. Apparatus, as set forth in claim 3, wherein each of the first piston means includes an actuating chamber and a piston having first and second ends, said first end being positioned in the actuating chamber and said second end being in engagement with the second check valve.

5. Apparatus, as set forth in claim 4, wherein the signal means includes a first line connecting the first actuating chamber of the first valve assembly with the load supporting end of the second hydraulic jack and a second line connecting the first actuating chamber of the second valve assembly with the load supporting end of the first hydraulic jack.

6. Apparatus, as set forth in claim 5 including an independent source of fluid and a selector valve connecting the independent source of fluid with the second piston means.

7. Apparatus, as set forth in claim 2, wherein each of the housings has first and second ports, said first port being connected to the control valve, said second port being connected to the associated load supporting end, said first and second ports being isolated from each other at the first position of the first check valve and in fluid communication with one another at the second position of the first check valve.

8. Apparatus, as set forth in claim 7, wherein the first check valve includes a cylindrical body having a cavity formed therein and opening into the chamber, first, second, third and fourth passages extending through the wall of the body and being axially spaced, said second port being in communication with the cavity through at least said first passage at the second position of the first check valve and said cavity being in fluid communication with the first port through the fourth passage at the second position of the first check valve.

9. Apparatus, as set forth in claim 8, wherein the second passage is larger than the first passage and smaller than the third passage.

10. Apparatus, as set forth in claim 8, wherein said cylindrical body of the first check valve has a fifth passage connecting the cavity with the first port, said second check valve includes an elongated stem having first and second ends and a conical seat adjacent the first end, said conical seat being sealingly seated in the fifth passage and said first end extends through the fifth passage at the first position of the second check valve.

11. Apparatus, as set forth in claim 10 including a third check valve positioned in parallel with the first check valve and being movable between a first position at which fluid in the second port is blocked from the first port and a second position at which fluid can freely flow between the first and second ports.

* * * * *